United States Patent [19]

Edman et al.

[11] 4,431,382

[45] Feb. 14, 1984

[54] APPARATUS FOR OIL BURNERS

[75] Inventors: Hans Edman, Vällingby; Arne Lönnebring, Älvsjö, both of Sweden

[73] Assignee: IMO AB, Stockholm, Sweden

[21] Appl. No.: 330,410

[22] Filed: Dec. 14, 1981

[30] Foreign Application Priority Data

Jan. 21, 1981 [SE] Sweden ..... 8100336

[51] Int. Cl.[3] ..... F04B 49/00

[52] U.S. Cl. ..... 417/302; 239/121; 417/442; 431/118

[58] Field of Search ..... 431/118; 239/121, 332; 417/295, 503, 507, 442, 302, 211.5; 137/859; 251/61.4, 61.1

[56] References Cited

U.S. PATENT DOCUMENTS

| | | | |
|---|---|---|---|
| 1,953,603 | 4/1934 | Hardy | 251/61.4 X |
| 3,685,925 | 8/1972 | McJones | 417/302 |
| 4,094,332 | 6/1978 | Poff et al. | 251/61.1 X |
| 4,139,156 | 2/1979 | Field et al. | 239/121 |
| 4,244,554 | 1/1981 | DiMauro et al. | 251/61.1 |
| 4,298,338 | 11/1981 | Babington | 431/175 X |

*Primary Examiner*—Edward K. Look

*Attorney, Agent, or Firm*—Pollock, VandeSande & Priddy

[57] ABSTRACT

Pump apparatus, for delivering oil to an oil burner which is supplied with oil in excess, the excess oil being collected in a vessel, includes a pump receiving oil partly from an oil tank and partly from the collection vessel, for delivering the oil to the burner. The pump is provided with separate inlets for oil from the tank and vessel. In the inlet for oil from the tank there is mounted a shut-off valve adapted for opening under the action of a sub-pressure on the pump suction side. In the inlet for oil from the collection vessel there is mounted a valve adapted for actuation by the head of liquid in the collection vessel for opening or closing when said head is respectively above or below a given level.

3 Claims, 1 Drawing Figure

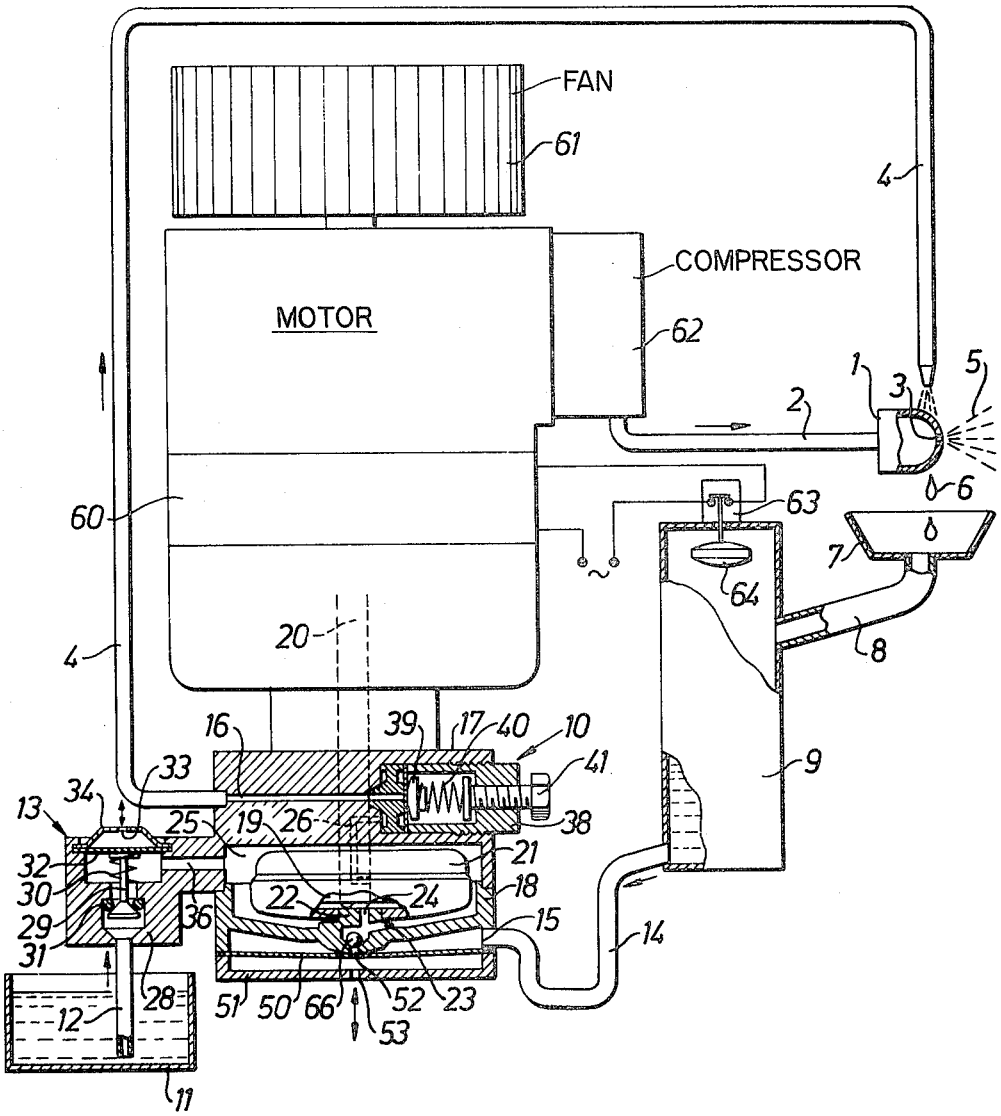
FAN
61
4
COMPRESSOR
MOTOR
62
1
3
5
2
6
63
60
7
64
20
8
4
16
39
17
40
10
41
9
33
34
13
25
19
26
38
21
32
30
22
24
18
29
36
15
31
14
28
51
50
66
52
23
12
53
11

APPARATUS FOR OIL BURNERS

FIELD OF THE INVENTION

The present invention relates to a pump apparatus for fuel oil burners of the kind where oil is taken to a jet or nozzle, in which the entire quantity of oil is not combusted, the excess being collected in a vessel and returned to the burner pump.

BRIEF DESCRIPTION OF THE PRIOR ART

To enable operation of oil burners with heavy oil, a new burner construction has recetly become current, where the oil is supplied to the outside of a special jet or nozzle, on which it spreads out as a film. Air at a given excess pressure is supplied to the interior of the jet body, wherefrom it is blown out through an orifice to finely divide the oil. Fine subdivision into considerably finer droplets than in conventional burner structures can be attained in this way, and thus the burner can work with heavier oil. The function of the burner requires, however, that oil is supplied to the burner jet in considerable excess, which may be 5–10 times the amount of oil finely divided by the air and combusted. The excess oil is collected in a vessel and taken back to the pump feeding the bruner, this pump thus having to take oil simultaneously from the oil tank and collection vessel for the excess oil.

BRIEF DESCRIPTION OF THE PRESENT INVENTION

The quantity of oil in the collection vessel may vary greatly, and the pump thus has to take a varying quantity of oil from the collection vessel. When the latter contains a small amount of oil the pump must take oil solely or principally from the tank. When the quantity of oil in the collection vessel rises, it is required instead that the pump takes an increasing amount of oil therefrom and a decreasing amount from the tank.

The invention has the object of providing an apparatus with which the distribution of the oil intake to the pump from the oil tank and collection vessel is automatically regulated.

BRIEF DESCRIPTION OF THE DRAWING

The invention will now be described in detail while referring to the appended drawing, which somewhat schematically depicts a burner of the type indicated above, equipped with an embodiment of the apparatus in accordance with the invention.

DETAILED DESCRIPTION OF THE INVENTION

The burner shown on the drawing includes a hollow body 1, connected to an air line 2 and provided on the opposite side with a small hole 3, through which the air supplied is blown out. Oil is delivered from a line 4 and runs down on the outside of the body 1, where it forms an oil film. The air flowing out from the hole 3 finely divides a part of the oil into very fine droplets, as is indicated at 5, while the remaining oil drops off from the body 1, as at 6. This excess oil is received in a funnel 7, placed under the body 1, a pipe 8 going from the funnel to the collection vessel 9, in which oil is continuously collected during operation of the burner.

The line 4 comes from the outlet of a pump 10, which receives oil both from an oil tank 11 via a pipe 12 and a regulating valve 13, and from the collection vessel 9 via a line 14 and an inlet 15, the pump delivering the oil via an outlet 16 to the line 4.

The pump 10, which is not shown in detail on the drawing, may be such as a radial piston pump according to the Swedish patent specification 335 477 or Swedish patent application 8003151-1. Such a pump includes: (a) a cylindrical rotor mounted in a housing, with at least one piston, which is sealingly and glidably accommodated in a piston chamber made radially in the rotor, the radial depth of said chamber being greater than the piston length, (b) an eccentric cam eccentrically surrounding the rotor, the piston following said profile when the rotor rotates, thus to provide the piston with radial reciprocating motion in the piston chamber, (c) a suction canal in communication with the liquid source, opening out into the piston chamber for sucking liquid into the chamber during the outward movement of the piston, and (d) an outlet canal opening out into the interior portion of the piston chamber, through which canal liquid is forced during the inward movement of the piston. The invention is not restricted to the use of such a pump, however.

The pump housing will be seen on the drawing, it comprises an upper part 17, a lower part 18, the rotor 19, a shaft 20 carrying and driving the rotor, and the cam profile 21 surrounding the rotor and mounted on a boss 22 formed on the lower part 18. There are bores 23 and 24 made in the boss and through said bores the portion of the inner chamber of the pump housing 17, 18 situated outside the cam profile 21 is in communication with the space situated inside the cam profile 21, and thereby with the piston chambers. The drawing also shows with dashed lines the outlet canal 26, which is made partly in the shaft 20 and partly in the upper part 17 of the pump housing.

The upper part 17 is made integral with the housing 28 of said valve 13. This valve includes a valve body, kept pressed against its seat 31 by a spring 30. The body 29 is further connected to a diaphragm 32, which has its upper side under the action of atmospheric pressure, via an orifice 33 in a cover 34 closing off the valve housing. The chamber under the diaphragm 32 is in communication with the oil line 12 via the valve seat and with the inner chamber 25 of the pump housing via an inlet 36.

The pump outlet canal 26 leads to a pressure regulating valve 38 in the pump housing upper part 17, and includes a valve body 39 loaded by a spring 40, having a bias which can be set by a screw 41. The valve is in communication with said outlet 16, and thereby with the oil line 4.

When the rotor 19 of the pump 10 rotates, and its pistons are in operation, a given sub-pressure occurs in the chamber 25, and thus on the underside of the diaphragm 32. The diaphragm is therefore deflected downwards so that the valve body is urged downwards against the bias of the spring 30, and the valve is opened. The pump thus sucks in oil from the tank 11 and delivers it via the outlet canal 26, valve 38 and outlet 16 to the line 4, and thereby to the burner.

A diaphragm 50 is clamped under the pump housing lower part 18 by means of a cover 51. In the bottom wall of the part 18 there is a small orifice 52, in communication with the canal formed by the bores 23, 24. The diaphragm 50 is mounted such that its central portion covers the small orifice 52. The inlet 15 for excess oil from the vessel is made in the part 18 above the diaphragm 50, but under the partition wall of the part 18, so that there is communication with the pump via the orifice 52, and so that the upper side of the diaphragm 50 is subjected to the pressure of the liquid in the vessel 9. There is an orifice 53 in the cover 51, enabling the underside of said diaphragm to be subjected to atmospheric pressure.

The pressure prevailing in the pump chamber 25, which is normally lower than atmospheric pressure when the pump is in operation, thus acts on the diaphragm against a very small central area, while the pressure from the liquid in the vessel 9 acts against a large area. Accordingly, the liquid pressure can press the diaphragm 50 from the orifice 52 for a relatively small head of liquid in the vessel 9, and open the communication so that the pump receives oil from vessel 9. However, as long as the liquid in the vessel remains below a certain level this communication is closed, and the pump only receives oil from the tank 11.

By the arrangement of the valve 13, which is closed when the pump is not in operation, there is prevented the situation that the vessel 9 will be emptied by the liquid running off via the pump when the latter is not in operation.

The pump 10 is driven via the shaft 20 by an electric motor mounted in a motor housing 60. This motor may also serve to drvie a fan 61 for supplying combustion air, as well as to drive a compressor, indicated at 62, for supplying the line 2 with compressed air.

A switch 63 may be provided in the motor power supply circuit for actuation by a float 64, mounted in the upper portion of the vessel 9, this switch interrupting the current to the motor, and thus inhibiting operation of the system, should the vessel 9 become overfull.

A non-return valve 66 is also suitably mounted at the orifice 52 to prevent the flow of oil from the pump 10 to the vessel 9, should the pressure in the pump chamber 25 exceed the pressure of the liquid in the vessel 9.

The illustrated apparatus with a diaphragm valve for regulating suction by the pump of oil from the collection vessel is a preferred arrangement. It is however conceivable to use a float in the vessel 9, for example, for controlling a suitable valve in the communication 14.

We claim:

1. An oil burner pumping station comprising:

a collection tank for collecting excess oil delivered to an oil burner;

a main supply tank;

pumping means having an outlet for delivering oil to the burner and having a first inlet connected to the main supply tank and a second inlet, communicating with the first inlet, and connected to the collection tank;

first valve means connected between the first inlet and the supply tank for supplying oil therebetween when the pressure at the first inlet drops below a preselected level;

second valve means connected between the second inlet and the collection tank for transferring excess oil therebetween when the head of oil in the collection tank exceeds a preselected level, independent of oil supply occurring from the main supply tank.

2. The structure set forth in claim 1 wherein the first valve means comprises:

a housing having a chamber formed therein communicating with the first inlet;

a biased valve member located in the housing for enabling fluid flow from the supply tank;

a valve stem located in the housing and connected to the valve member; and a diaphragm connected to the stem and mounted to the housing, one side of the diaphragm exposed to the atmosphere and the other side exposed to pressure in the chamber, the diaphragm causing the valve member to open when the pressure at the first inlet drops below a preselected value.

3. The structure set forth in claims 1 or 2 wherein the second valve means comprises:

a second housing having a second chamber formed therein communicating with the second inlet;

a second diaphragm mounted in the second housing and normally sealing the second inlet, one side of the second diaphragm exposed to the atmosphere, the other side subjected to dual pressure zones including (a) a central first pressure zone defined by the diaphragm area bounded by the second inlet; and (b) a second opposing pressure zone, larger than the first zone and defined by the remaining diaphragm area which is exposed to the second chamber;

the second diaphragm opening from the second inlet when the head of oil in the collection tank exceeds a preselected level.

* * * * *